United States Patent [19]

Greer

[11] Patent Number: 4,671,568

[45] Date of Patent: Jun. 9, 1987

[54] TERRY CLOTH MATTRESS AND LAWN CHAIR COVER WITH CONTINUOUS ELASTIC BORDER

[76] Inventor: Stephen L. Greer, 1209 N. State Pkwy., Apt. 7, Chicago, Ill. 60610

[21] Appl. No.: 759,229

[22] Filed: Jul. 26, 1985

[51] Int. Cl.[4] ..... A47C 31/10

[52] U.S. Cl. ..... 297/229; 5/497

[58] Field of Search ..... 297/229, 219, 224, 457; 5/485, 496, 499, 497

[56] References Cited

U.S. PATENT DOCUMENTS

| | | | |
|---|---|---|---|
| 2,807,314 | 9/1957 | Larkin | 297/229 |
| 3,144,666 | 8/1964 | Mazera et al. | 5/497 |
| 3,338,630 | 8/1967 | Dudley | 297/219 |
| 4,536,028 | 8/1985 | Jones et al. | 297/224 |
| 4,553,785 | 11/1985 | Duke, Jr. | 297/229 |

FOREIGN PATENT DOCUMENTS

| | | | |
|---|---|---|---|
| 1100158 | 3/1955 | France | 297/229 |
| 1188062 | 4/1970 | United Kingdom | 297/219 |
| 1275736 | 5/1972 | United Kingdom | 297/224 |

*Primary Examiner*—Peter A. Aschenbrenner

*Attorney, Agent, or Firm*—Marvin N. Benn; Milton S. Gerstein

[57] ABSTRACT

A towel cover made of terry cloth is provided with a peripheral hem in which is inserted an elastic band to cause snug-fitting of the towel to an air mattress or a mattress of a lawn chair. The towel also has a plurality of loops formed in the edge of the peripheral hem which cooperate with elastic fastening bands that couple oppositely-disposed loops together, so as to prevent lateral slippage of the towel relative to the mattress. Each end of a fastening band is provided with a pair of spaced-apart buttons which are selectively insertable into one of the loops to adjust the biassing force of the band to suit the type and size of mattress being covered.

11 Claims, 6 Drawing Figures

TERRY CLOTH MATTRESS AND LAWN CHAIR COVER WITH CONTINUOUS ELASTIC BORDER

BACKGROUND OF THE INVENTION

The present invention is directed to a terry cloth cover for a lawn chair, air mattress, and the like, for providing comfort and ease of installation to a user. Covers for lawn chairs and air mattresses in use today are generally simple towels that are draped over the mattress or lawn chair, with the attendant disadvantage of recurring slippage of the towel from the mattress or chair. The slippage necessitates the continual re-positioning of the towel on the chair or mattress, so that it extends along the length of the surface lain upon.

SUMMARY OF THE INVENTION

It is the primary objective of the present invention to provide a cover for a lawn chair, air mattress, or the like, which cover fits snugly thereabout without the continual problem of slippage.

It is another objective of the present invention to provide a cover for a lawn chair, air mattress, or the like, which cover is provided with a circumferential elastic band that assures close fitting of the cover to the undersurface.

It is still another objective of the present invention to provide a cover for a lawn chair or air mattress, which cover is made of terry cloth, and which cover includes a plurality of fastening members extending beneath the undersurface of the chair or mattress, which fastening members include button-and-loop type fasteners to ensure that no portion of the terry cloth cover will slip from the portion of the undersurface on which it rests.

It is yet another objective of the present invention to provide for the terry cloth cover a pair of re-closable side pockets in which may be stored cigarettes, coins, and the like, with each side pocket being made of the same material as the rest of the cover and formed integrally therewith.

BRIEF DESCRIPTION OF THE DRAWING

The invention will be more readily understood with reference to the accompanying drawing, wherein.

DETAILED DESCRIPTION OF THE INVENTION

Figure 1:
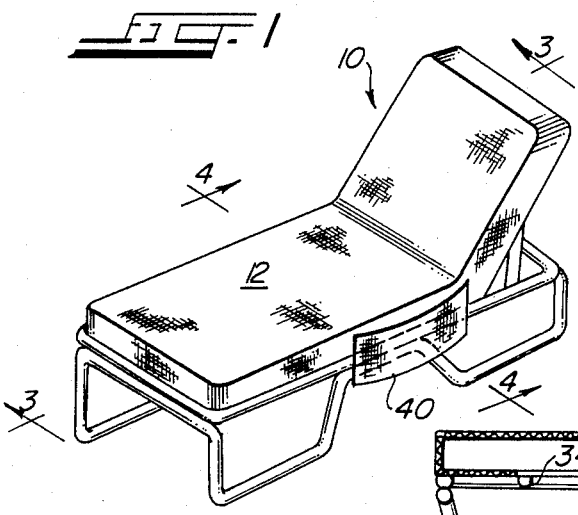
FIG. 1 is a perspective view showing a lawn chair covered with the snug-fitting terry cloth cover of the present invention.
Figure 2:
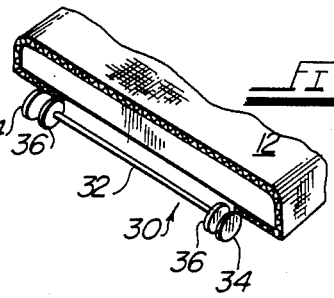
FIG. 2 is a cross-sectional view showing one of the fastening elements used for fastening a portion of the terry cloth cover of the invention to the underside of the lawn chair mattress.
Figure 3:
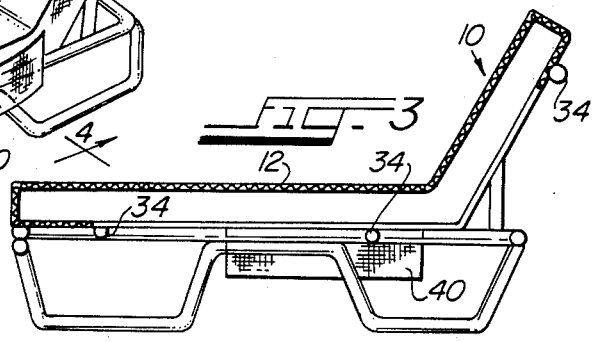
FIG. 3 is a side cross-sectional view taken along line 3—3 of FIG. 1, which shows the three festening elements used to attach the cover of the invention to the mattress without slippage thereof.
Figure 4:
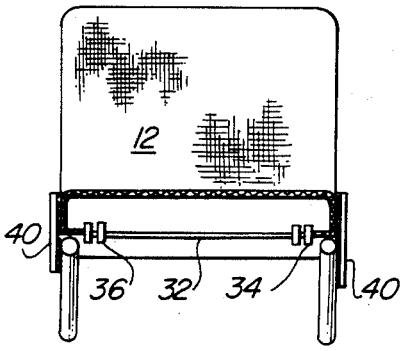
FIG. 4 is a cross-sectional view taken along line 4—4 of FIG. 1 also showing a fastening element spanned between a pair of loop elements of the terry cloth cover of the invention to hold a portion of the cover in place and to prevent its slippage relative to the mattress.
Figure 5:
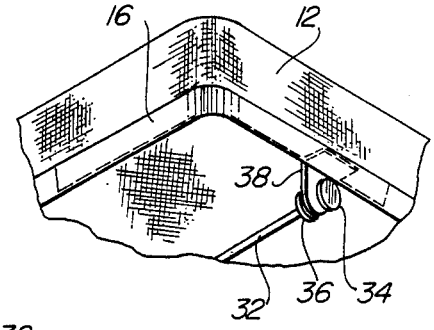
FIG. 5 is a perspective view showing the underside of the chair mattress with the circumferential elastic band holding the terry cloth of the invention snugly in place over the chair mattress, and also shows a fastening element used to prevent slippage of the cover relative to the mattress surface.
Figure 6:
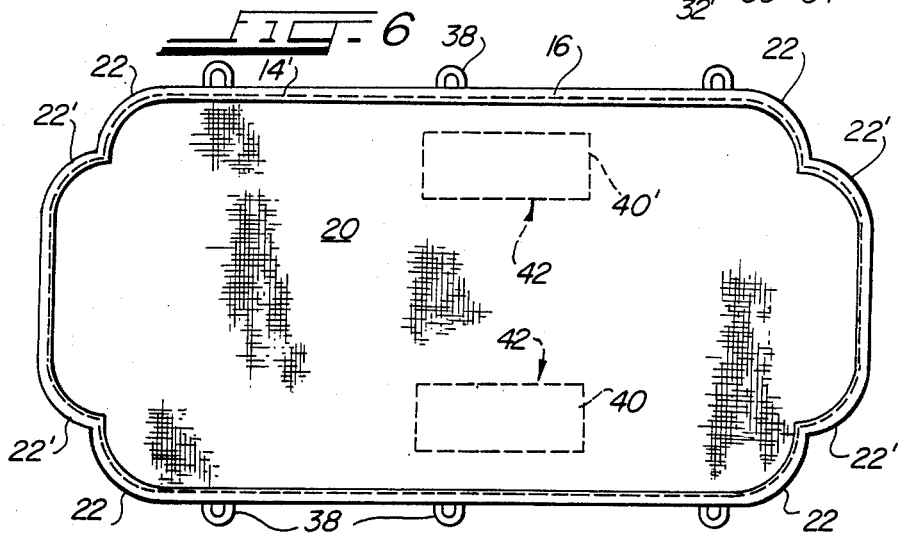
FIG. 6 is a plan view showing the flat cloth pattern of terry cloth from which the circumferential, elasticized cover is made along with the pair of side pockets, from which pattern the finished cover is formed via stitching.

Referring now to the drawing in greater detail, FIG. 1 shows a lawn chair 10 covered with the circumferential, elasticized terry cloth cover of the present invention, indicated by reference numeral 12, with a side storage pocket 40 used for storing articles therein, such as cigarettes, coins, sun tan lotion, and the like. The cover 12 is provided with a circumferential, elastic band 14' best seen in FIG. 6. The elastic band is contained in the peripheral hem 16 of the cover 12, which hem is first formed in the cover-pattern 20 shown in FIG. 6 from which the finished cover is made via stitching. In FIG. 6, to form the finished cover 12, each rounded corner 22 is stitched to its directly adjacent rounded corner 22' such that the finished cover 12 is provided with snug-fitting corners that snugly hug the four corners of the mattress of the lawn chair or air mattress with which it is used, in the manner that a fitted bed sheet snugly fits over the four corners of the mattress of the bed with which it is used. Such elasticized corners prevent the sheet from longitudinal movement relative to the mattress which it covers. In the present invention, the completely circumferential, elasticized border also prevents relative transverse movement of the terry cloth towel 14. Further, since the terry cloth towel is used on a supporting mattress that is designed to take different shapes, such as the bent one shown in FIG. 1, additional transverse-movement preventing means are provided. These additional preventing means are in the form of a plurality of elastic, elongated bands 30, one being shown in FIG. 2. Each band 30 includes a main, elongated elasticized portion 32. At each end of this portion 32, there are provided a pair of buttons or small discs with a separation being formed therebetween. Each pair of buttons includes an outer button 34 and an inner button 36, with the outer button 34 insertable through a closed loop 38 formed in the outer edge portion of the cover. As shown in FIG. 6, three pairs of closed loops 38 are provided along three portions of the cover 12. Each loop 38 may be formed of the same terry cloth material as the rest of the cover, or may be made of any other suitable material bonded to the peripheral edges of the cover 12. Fastening of the band 30 between two aligned and oppositely-situated loops 38 is accomplished by inserting the outer button 34 through the opening of the loop 38 so that the buttons 34 and 36 of each pair sandwich therebetween a respective eye-loops 38. The outer button 34 is inserted through the respective loop 38 such that such insertion offers some resistance owing to the constricted opening of the loop 38. Each loop 38 is preferably made such that it is at least somewhat elastic to allow easier insertion of the outer button therethrough, though non-elasticized hooks may be used instead, with a concomitant enlargement of the opening being provided. As can be seen in FIGS. 2 and 5, each band 30 spans the mattress being covered on the underside thereof so that it is not seen and so that it may draw toward each other the respective pair of eye-loops between which its extends, to thus hold the cover in place to prevent lateral movement of the cover relative to the mattress. In the preferred embodiment, the three pairs of eye-loops 38 are so spaced so as to provide a first pair of loops adjacent the first end of the cover, a second pair midway between the ends of the cover, and a third pair adjacent the other end of the cover. However, depending upon the environment with which the cover of the invention is to be used, more or less than three pairs of loops 38 may be provided. Further, as can be seen in FIG. 5, the loops themselves are drawn under the mattress by the bands so that they are not visible from above.

It is also noted that the inner button 36 may also be used for insertion into its respective eye-loop 38 so that increased restraining effect is provided by the band 30, which may be desired after prolonged use of the cover 12, which would tend to stretch out the elasticized border of the cover 12, thus requiring additional holding power for the bands. Also, the inner button 36 may be used for fitting about a mattress of lesser girth than that normally designed for where the outer button would be utilized.

The terry cloth towel cover 12 is also preferably provided with a pair of side pockets 40 which may be used to store articles, such as coins, cigarettes, and the like. Preferably, each side pocket is positioned at that location along the length of the cover 12 that would allow ease of access thereto by the person lying on the towel cover, such location being adjacent the middle portion of the cover where the hands of the person lying may be most easily directed. The pocket 40 is preferably stitched on three of its edges to the main portion of the cover with a fourth edge thereof being left unstitched to provide entry therein. The cover 12 may also be provided, in combination with the pocket 40, with hook-and-pile fasteners so that the opening of the pocket 40 may be alternatively opened and closed-off with ease. In FIG. 6, the dotted blocks 40' outline the locations where the pockets 40 are to be stitched, or otherwise attached to the cover 12. The dotted lines 42 shown in FIG. 6 indicate the location of the fourth edge of the pocket 40 that is not stitched or bonded to the cover 12 to form the opening of the pocket. As mentioned above, hook-and-pile fasteners may be used on the inside of the pocket and the outer surface of the towel cover to allow for a reclosable pocket opening. The pocket 40 may also be made so as to hang below the mattress, in the manner shown in FIG. 1. In this case, the lower-most edge of the pocket is not bonded or stitched to the cover. In this instance, a self-contained pocket is used that is made up of a pair of oppositely-disposed layers of fabric, or the like, with the inner layer being stitched or bonded to the towel cover along approximately half of its descent down the side of the towel cover. The lower edges of the inner and outer layers would be stitched to each other to form the bottom of the pocket, in the well-known manner.

It can, therefore, be seen that the terry cloth towel cover of the present invention ensures that slippage, either in the longitudinal or lateral directions, is effectively prevented and allows for easy and quick adaption of the towel to variously sized mattresses to ensure such slippage-prevention.

While a specific embodiment of the invention has been shown and described, it is to be understood that numerous changes and modifications thereof may be made without departing from the scope, spirit and intent of the invention, as set out in the appended claims.

What is claimed is:

1. A cover for a lawn chair, air mattress, and the like, comprising:

a terry cloth towel main body portion having a circumferential border hem portion;

an elastic strip positioned in said circumferential border and extending along the entire length thereof so that said main body portion is completely encircled by said elastic strip to make said main body portion fit snugly to a mattress and to prevent longitudinal slippage of said terry cloth towel main body portion relative to said mattress;

a plurality of fastening bands each having a first end comprising a first attaching means, and a second end comprising a second attaching means, each of said plurality of fastening bands being made of an elastic material for the stretching thereof;

a plurality of pairs of closed loop members for cooperative interaction with said first and second attaching means of said plurality of fastening bands, each of said plurality of closed loop members having a first loop fixedly secured to a first portion of the periphery of said main body portion and a second loop fixedly secured to a second diametrically-opposed portion of said main body portion, each said loop being capable of holding a respective one of said first and second attaching means; said plurality of pairs of loop members being spaced longitudinally apart along the length of said main body portions;

each of said first and second attaching means comprising a first outer button element for insertion into a respective said loop, and a second inner button element, such that said first and second button elements sandwich therebetween a respective said loop during normal attachment of said main body portion to a mattress, whereby said second inner button element may be inserted through said respective loop member to provide increased holding retention of said band to prevent lateral slippage of said main body portion relative to the mattress.

2. The cover according to claim 1, wherein said main body portion further comprises at least one side pocket having a first, second and third edge thereof permanently secured to a portion of said hem portion of said main body portion on the outer surface of said hem portion, and fourth edge freely movable relative to said hem portion to form a reclosable opening, said hem portion having in cooperation with said fourth edge a hook-and-pile fastening means for allowing the alternative opening and closing of said at least one side pocket for storing articles therein.

3. The cover according to claim 2, wherein each of said loops comprises a central, hollow opening through which said first and second button elements may pass for fastening said band between respective loops of a pair of said loop members.

4. The cover according to claim 3, comprising three said fastening bands and three said pairs of loop members, said three pairs of loop members dividing said main body portion into four sections along the length of said main body portion.

5. The cover according to claim 4, comprising four said fastening bands and four pairs of said loop members.

6. A cover for a lawn chair, air mattress, and the like, comprising:

a terry cloth towel having hemmed peripheral border;

an elastic band formed in said hemmed peripheral border extending completely around the circumference of said towel to cause the towel to fit snuggly above a mattress to prevent longitudinal slippage of said towel relative to said mattress;

a pocket formed along one portion of said hemmed peripheral border for storing articles therein, said pocket being reclosable;

a pair of oppositely disposed loops lying on diametrically opposite sides of said hemmed peripheral border, each said loop having a central cut-out;

an elastic fastening band for interconnection between said pair of loops, said fastening band having a first attaching means at a first end thereof for insertion into one of said loops of said pair of loops, and a second attaching means at a second end thereof for insertion into the other of said pair of loops, each said attaching means firmly holding its respective end of said fastening band to its respective said loop; said fastening and extending between said pair of loops on the underside of said terry cloth towel, which underside rests directly upon the supporting surface of the mattress to be covered; said fastening band also extending below the mattress such that said band firmly holds in place said terry cloth towel to prevent lateral slippage thereof relative to the mattress;

said pair of loops being located at the mid-portion of said terry cloth towel along the length thereof; said side pocket having a downwardly extending portion that protrudes below the undersurface of the mattress once a cover is positioned over the mattress; said hemmed peripheral border and said pocket having a cooperating hook-and pile fastening means for allowing reclosing and reopening of said side pocket;

a mattress over which said terry cloth towel is spanned, said pair of loops being positioned below said mattress and inward of the respective outer edge thereof; said fastening band lying totally under said mattress along the entire length thereof from said first attaching means to said second attaching means;

said first and second attaching means each comprising a first outer button element for insertion through a respective loop, and a second button element for alternatively sandwiching the respective loop between said button elements, and for insertion through the respective loop to cause said fastening band to increase its holding force.

7. The cover according to claim 6, wherein said fastening band comprises an elastic main body portion extending between said first and second attaching means for extension and contraction to provide the additional restraining force to ensure non-slippage of the towel in the lateral direction.

8. The cover according to claim 7, wherein said hemmed peripheral border is positioned under said mattress along the entire circumferential length thereof, said loops extending downwardly therefrom.

9. The cover according to claim 8, comprising three said fastening bands spaced along the length of said towel, and three pairs of said loops also spaced along said towel.

10. The cover according to claim 9, wherein said pocket comprises a layer of fabric superimposed over a portion of said towel extending downwardly along a side edge surface of said mattress, said layer of fabric being permanently secured to a portion of said towel superimposed over said side edge surface of said mattress along three of its edges thereof, and a fourth upper edge thereof being free from permanent securement with said portion of said towel, so as to allow access into said pocket.

11. The cover according to claim 10, wherein said portion of said towel and said fourth edge of said pocket comprise cooperating hook-and-pile fastening means for forming a reclosable opening for said pocket.

* * * * *